US005334002A

United States Patent [19]

Hodge

[11] Patent Number: 5,334,002

[45] Date of Patent: Aug. 2, 1994

[54] GEROTOR PUMP WITH SHIFTABLE ROTOR BOSS

[75] Inventor: Steve Hodge, Tamworth, United Kingdom

[73] Assignee: Concentric Pumps Limited, Great Britain

[21] Appl. No.: 39,321

[22] PCT Filed: Oct. 22, 1991

[86] PCT No.: PCT/GB91/01843

§ 371 Date: Apr. 23, 1993

§ 102(e) Date: Apr. 23, 1993

[87] PCT Pub. No. WO92/08895

PCT Pub. Date: May 29, 1992

[30] Foreign Application Priority Data

Nov. 10, 1990 [GB] United Kingdom ..... 9024492.2

[51] Int. Cl.[5] ..... F01C 21/16

[52] U.S. Cl. ..... 418/32

[58] Field of Search ..... 418/32

[56] References Cited

U.S. PATENT DOCUMENTS 3,478,693 11/1969 Bangs ..... 418/32

FOREIGN PATENT DOCUMENTS 518583 1/1931 Fed. Rep. of Germany .
1149821 1/1958 France .
1095923 12/1967 United Kingdom .
1542618 4/1976 United Kingdom .

*Primary Examiner*—Richard A. Bertsch
*Assistant Examiner*—Charles G. Freay
*Attorney, Agent, or Firm*—Learman & McCulloch

[57] ABSTRACT

A gerotor pump comprises the usual lobed annulus 30 containing the lobed rotor (not shown in FIG. 2) which is journalled on cylindrical boss 36. The boss is free to turn on the eccentric pin 38 between positions controlled by limit pin 42 encountering end abutments. This enables the pump to automatically adjust to the variable direction of drive of the annulus—in this case via coupling 32—so as to be unidirectional in fluid output via flow passages 16 18.

9 Claims, 2 Drawing Sheets

GEROTOR PUMP WITH SHIFTABLE ROTOR BOSS

This invention relates to pumps of the kind comprising a male rotor with n lobes which is located internally of and meshed with a female annulus having n+1 lobes. These two form a gerotor set which is driven either from the annulus or the rotor and the two turn relative to one another and about parallel axes. A series of chambers is formed between the lobes and each chamber extends between two lines of contact between the rotor and annulus. These lines lie generally on the peaks, or maximum radius portions of the rotor lobes, and move along the annulus as the parts rotate at different speed. Hence the chambers increase in size as they proceed from a position adjacent a plane containing both axes and adjacent the point of full mesh between a male lobe and a female recess between lobes (or vice versa) towards a diametrically opposite position at a place where only the crests (maximum radius portions) of the lobes of both rotor and annulus meet. This travel is the induction stroke and fluid is sucked into the chambers as they follow this path from an inlet port at an axial end of the chambers.

Similarly, as the chambers continue in their travel on the opposite side of said plane returning to the start point, they diminish and expel fluid through a second port or outlet.

As stated, pumps of the kind mentioned in the foregoing two paragraphs are well known and exist in many variations.

With internal combustion engines the direction of rotation of the main shaft (e.g. the crank shaft of the engine) is usually unidirectional because of valve timing and ignition timing requirements, and hence a pump of this kind e.g. used as the lubrication oil pump and driven from such a crankshaft is also unidirectional. But with certain rotary machines for example some kind of compressors, the direction of rotation is unimportant and may vary from one cycle of operation to another. If a gerotor pump is used with such a machine, the effect on the pump of changing the direction of rotation is to expel fluid through the inlet and suck through the outlet: usually this is unacceptable.

It is therefore known in the prior art to provide means for shifting the eccentricity of one axis of the gerotor relative to the other, according to the direction in which the annulus or rotor is driven. Usually the shift is through 180 degrees in said reversal that is from one side of the stationary axis to the other. This enables the inlet and outlet to remain unchanged and give unidirectional flow through the pump irrespective of reversible drive direction.

Many different schemes have been put forward to cause the automatic shift. Thus it is known to mount the annulus in an eccentric ring which is itself angularly movable in a pump body cavity, and to dispose a blade spring between the annulus and the eccentric so as to create a frictional drag between the two. When the annulus turns in one direction, this drags the eccentric ring to one position against the stop and hence fixes the position of the axes. When the drive direction is reversed, the spring drags the eccentric in the opposite direction and hence changes the axis positions. Difficulties with this design are power loss caused by the frictional drag, which is effective during the whole of the operation although only needed at the start-up point, and the additional space required to accommodate the additional component, i.e. the eccentric ring.

Another approach has located the annulus in a carrier ring which is freely pivoted, and use the carrier ring to shift the position of the parts with respect to a drive shaft so as to bring about the required result, but again extra components and additional volume are required and the operation is not found reliable.

A proposal in prior patent GB 1095923 uses a cylindrical carrier member which is journalled in the pump structure at one axial side of the gerotor set, the axis of the carrier being coaxial with the gerotor annulus, and provides a smaller diameter eccentrically located cylindrical extension on one end of the carrier, that extension projecting into the male rotor and being coaxial therewith and journalling the rotor. A stop pin on the pump body projects into a recess in the carrier and limits angular movement to about the 180 deg. necessary to take the rotor between the two positions needful according to the direction of rotation of the gerotor set. This arrangement allows for pressure driven shifting of eccentricity of the male rotor and hence an automatic reversal so as to give unidirectional flow, but does so at the cost of increasing the size and weight of the structure quite substantially.

The object of the present invention is to solve the problem and provide improvements and particularly reduce both the number of components needed and the volume required.

According to the invention a pump of the kind comprising a body, a gerotor set of male rotor with n lobes located and meshed in an internally lobed female annulus with n+1 lobes all located in a cylindrical cavity in said body, with inlet and outlet ports opening to the series of chambers formed between the two lobed parts, and in which said rotor is journalled on a boss which is cylindrical about a first axis, said boss being mounted for angular movement through about 180 deg. only about a second and parallel axis is characterised in that said boss is provided with a first pin of smaller diameter than the boss projecting therefrom on said second axis and located in a complementary bore in at least the pump body said pin journalling the boss for its limited angular movement.

Preferably drive is transmitted by the annulus because this simplifies matters, but it is possible to arrange for drive to the rotor at the alternative positions occupied according to the direction of drive.

The invention is now more particularly described with reference to the accompanying drawings wherein.

Figure 1:
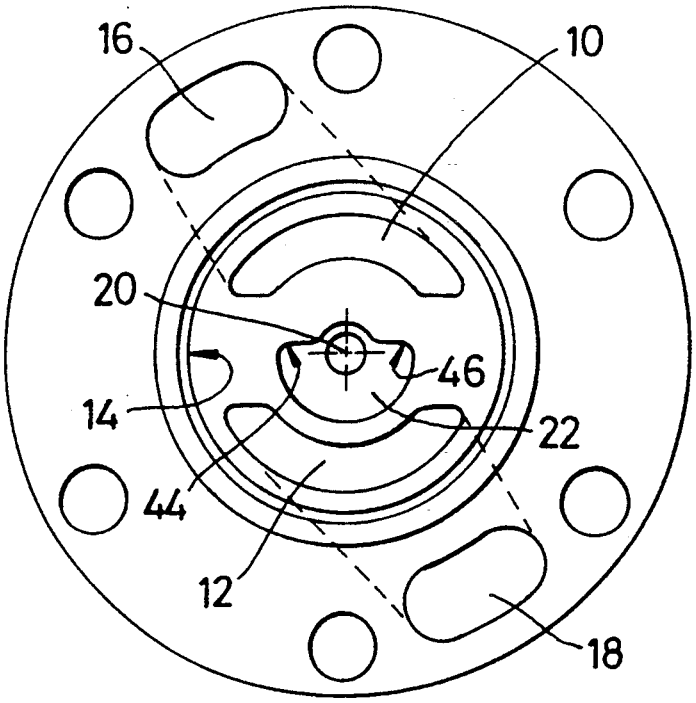
FIG. 1 is an end elevation of a pump body to house a gerotor pump set

Turning first to FIG. 1, this shows the inlet and outlet ports 10, 12 relative to the circular chamber bounded by the line 14 which in use contains the annulus (not shown) of the gerotor set These ports are communicated to flow passages which may lead for example to an inlet port 16 and an outlet port 18. Also indicated is central axis 20 which is concentric to the surface 14, and a cut-away 22 extending arcuately over about 180° about the centre 20.

Figure 2:
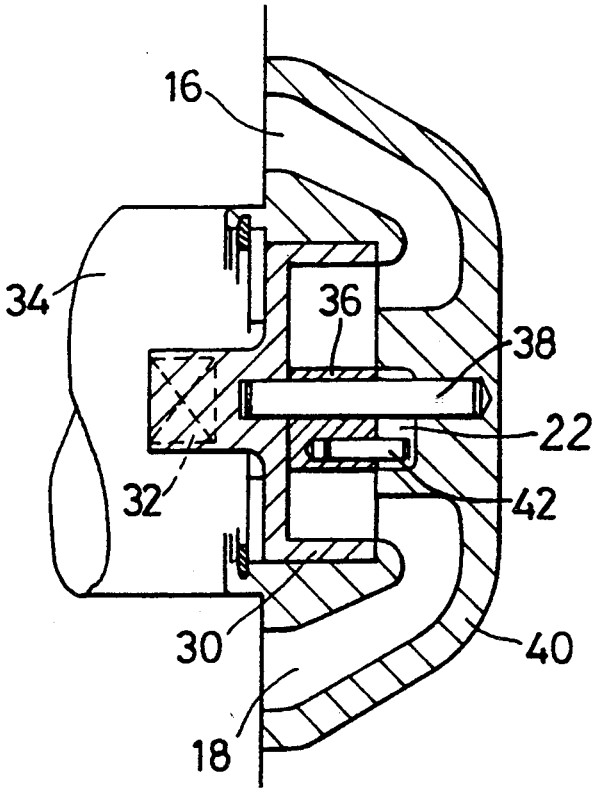
FIG. 2 is a sectional elevation of the same but with parts removed for clarity

In FIG. 2, the pump set annulus 30 is shown, which is internally lobed with n+1 lobes and is connected for drive by means of co-axial projection 32 which may for example be engaged with the end of a crankshaft 34 by means of flats or a key and keyway. The rotor, not shown, having n lobes is located internally of the annulus and has a concentric bore journalled on boss 36.

The boss is cylindrical and has a main axis. Hence the rotor turns about that axis when the annulus is driven.

Figure 4:
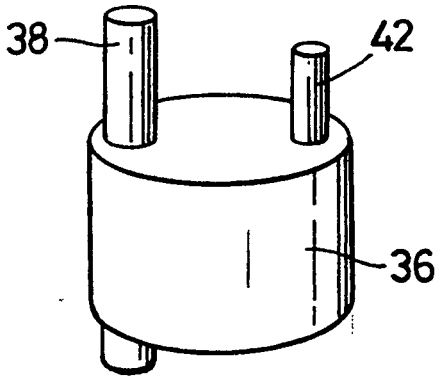
FIG. 4 is a perspective view of an eccentric used in the various embodiments.

The boss 36 (see also FIG. 4) is, in FIG. 2, journalled on the fulcrum pin 38 which is eccentric of the boss main axis, and this pin may be fast, for example a drive fit, in a bore in the end wall of the annulus or in the parallel face of the cover component 40.

The limit pin 42 is carried by the boss 36.

In operation, the annulus is driven, and this transmits drive to the rotor albeit at a different speed, so that the rotor turns on the boss 36. The pressure difference between one side of the pump and the other due to the direction of turning causes the boss 36 to pivot on the fulcrum 38 until the limit pin 42 reaches one or other end of the recess 22 according to the direction of the pressure difference. When the direction of rotation of the annulus changes, the boss 36 automatically moves around to re-position the rotor and take the limit pin 42 from one end to the other of the recess.

Figure 3:
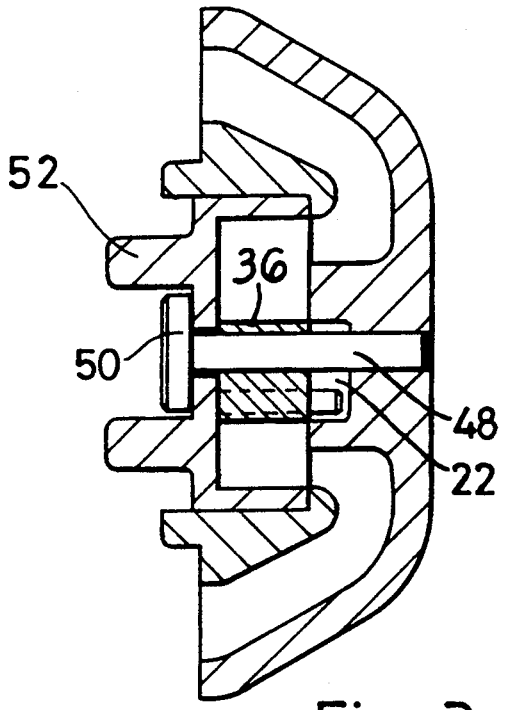
FIG. 3 is an alternative embodiment.

The arrangement in FIG. 3 differs only in that the boss 36 is journalled on pivot pin 48 which has a head 50 and in that the annulus has drive means 52 engaging with the crankshaft or like.

It will be appreciated by those skilled in the art that the pin 38 could be made integral with the boss 36 for example by a powder moulding technique. So could the pin 42. Alternative annulus drive means may be used, for example by providing the annulus with external gear teeth and transmitting drive from a pinion train. Alternatively, the rotor can be driven, for example by providing the rotor with a portion projecting through the pump body.

I claim:

1. A gerotor pump comprising a pump body; an externally lobed rotor having n lobes and an internally lobed annulus having n+1 lobes meshing with the lobes of said rotor to provide a series of interlobe chambers therebetween, said annulus and said rotor being rotatable about respective parallel axes so that said chambers rotate about said axes and continuously alternately increase and decrease in size; an inlet port and an outlet port opening through said body into said chambers, said inlet port being located so that said chambers move over said inlet port as said chambers increase in size during one half revolution of said chambers and said outlet port being located so that said chambers move over said outlet port as said chambers decrease in size during a successive half revolution;

a cylindrical boss journalling said rotor, said boss including a first pin supported by said body and extending along the axis of rotation of said annulus, and a second pin parallel to and spaced from said first pin; and a pin-accommodating recess provided in said body having a pair of opposite end faces forming abutment stops, said second pin being accommodated in said recess and movable between said abutment stops by angular movement of said boss about the axis of said first pin so as selectively to change eccentricity of said rotor relative to said annulus, said recess being located between said inlet port and said outlet port.

2. The pump of claim 1 wherein said first pin has one end projecting beyond said boss and journalling said annulus.

3. The pump of claim 1 wherein said first pin is supported at both of its ends.

4. The pump of claim 1 wherein said first pin is solid in section.

5. A reversible gerotor pump comprising a pump body having an axially recessed cylindrical cavity;

a boss accommodated within said cavity having a central axis;

a first eccentric mounting said boss having one axial end supported by said pump body and an opposite axial end projecting beyond said boss;

means limiting the angular travel of said boss to 180°;

an externally lobed rotor journalled by said boss having n lobe sections;

an internally lobed annulus journalled by said opposite end of said first pin for selective reversible rotation about the first pin axis, said annulus having n+1 lobe sections meshed with said lobe sections of said rotor to provide a series of continuously alternately increasable and decreasable interlobe chambers for pumping fluid; and fluid inlet and outlet passages in said body communicating with said chambers for admitting and discharging the fluid to and from said chambers.

6. The apparatus of claim 5 wherein said inlet and outlet passages extend through said body and open directly into said chambers.

7. The apparatus of claim 5 wherein said means for limiting movement of said boss comprises a second pin projecting from said boss and parallel to said first pin, and a recess in said body having end walls spaced 180° from one another, said second pin being accommodated within said recess and movable therein between said end walls.

8. The apparatus of claim 5 wherein said first pin is solid in section.

9. The apparatus of claim 5 wherein said boss is journalled on said first pin.

* * * * *